US006341452B1

(12) United States Patent
Böllinghaus

(10) Patent No.: US 6,341,452 B1
(45) Date of Patent: Jan. 29, 2002

(54) TRANSPORT ANCHOR FOR EMBEDDING IN PREFABRICATED REINFORCED CONCRETE PARTS

(75) Inventor: Rainer Böllinghaus, Schalksmühle (DE)

(73) Assignee: Gebr. Seifert GmbH & Co., Schalksmühle (DE)

( * ) Notice: Subject to any disclaimer, the term of this patent is extended or adjusted under 35 U.S.C. 154(b) by 0 days.

(21) Appl. No.: 09/686,771

(22) Filed: Oct. 11, 2000

(30) Foreign Application Priority Data

Oct. 21, 1999 (DE) ..... 199 50 675

(51) Int. Cl.[7] ..... E04G 21/12; E04G 1/38; E04B 1/38; B28B 7/16

(52) U.S. Cl. ..... 52/125.5; 52/125.4; 52/687; 249/97; 249/175; 294/90

(58) Field of Search ..... 52/125.4, 125.5, 52/576, 125.1, 125.6, 687; 249/91, 97, 175; 294/90

(56) References Cited

U.S. PATENT DOCUMENTS 3,861,106 A * 1/1975 Erhart ..... 52/125.4 X
4,000,591 A * 1/1977 Courtois ..... 52/125.4
4,290,638 A * 9/1981 Manning ..... 294/89
4,296,909 A * 10/1981 Haeussler ..... 249/94
4,417,425 A * 11/1983 Case ..... 52/125.5
4,437,642 A * 3/1984 Holt ..... 249/175
4,580,378 A * 4/1986 Kelly et al. ..... 52/125.5
4,807,843 A * 2/1989 Courtois ..... 249/61
4,821,994 A * 4/1989 Fricker ..... 249/91
4,888,922 A * 12/1989 Lancelot ..... 52/124.2
5,535,979 A * 7/1996 Ellis-Callow ..... 249/175 X

* cited by examiner

*Primary Examiner*—Winnie S. Yip
(74) *Attorney, Agent, or Firm*—Friedrich Kueffner

(57) ABSTRACT

A transport anchor for embedding in prefabricated reinforced concrete parts has an anchor shaft having a first shaft portion and a second shaft portion. The first shaft portion can be anchored in the concrete and has a support with at least one spacer projection for maintaining a spacing to a formwork wall. The second shaft portion projects from the concrete and has an engagement head. A prism-shaped formed member has two shell parts and surrounds the engagement head. A removable recess member encloses the engagement head during casting of the concrete. The removable recess member has a hub portion to be seated on the prism-shaped formed member.

13 Claims, 2 Drawing Sheets

FIG.1
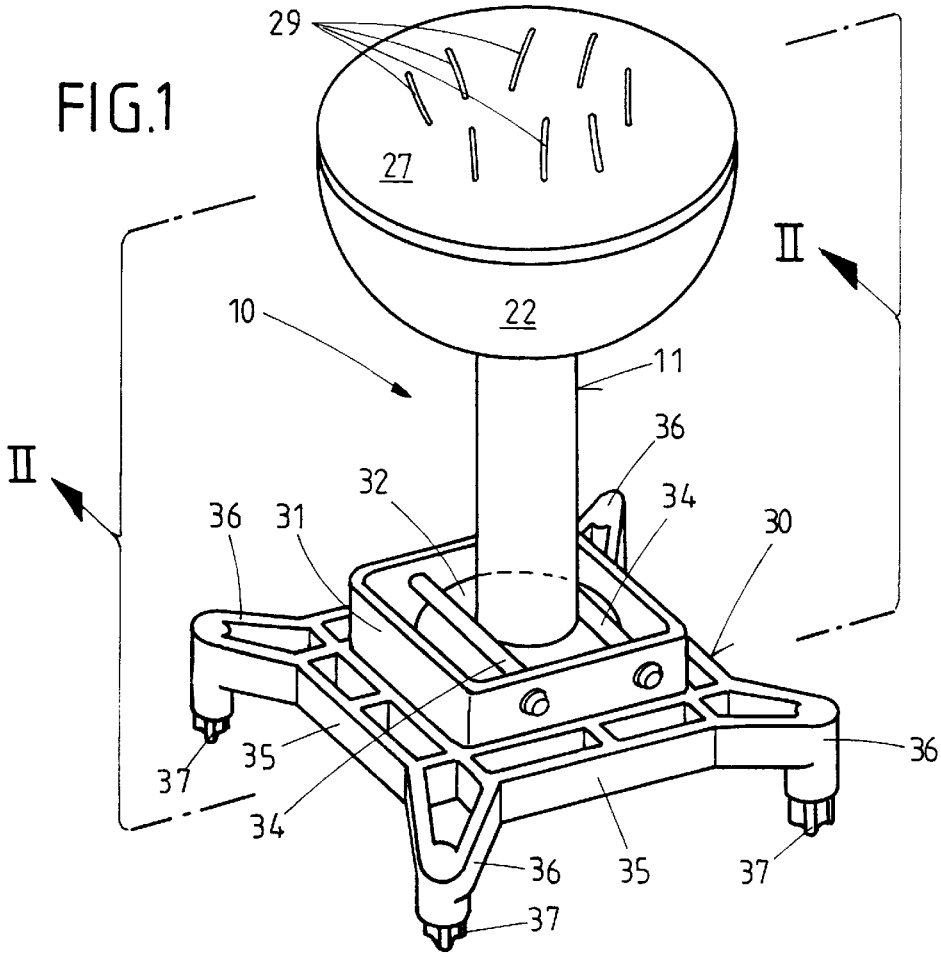
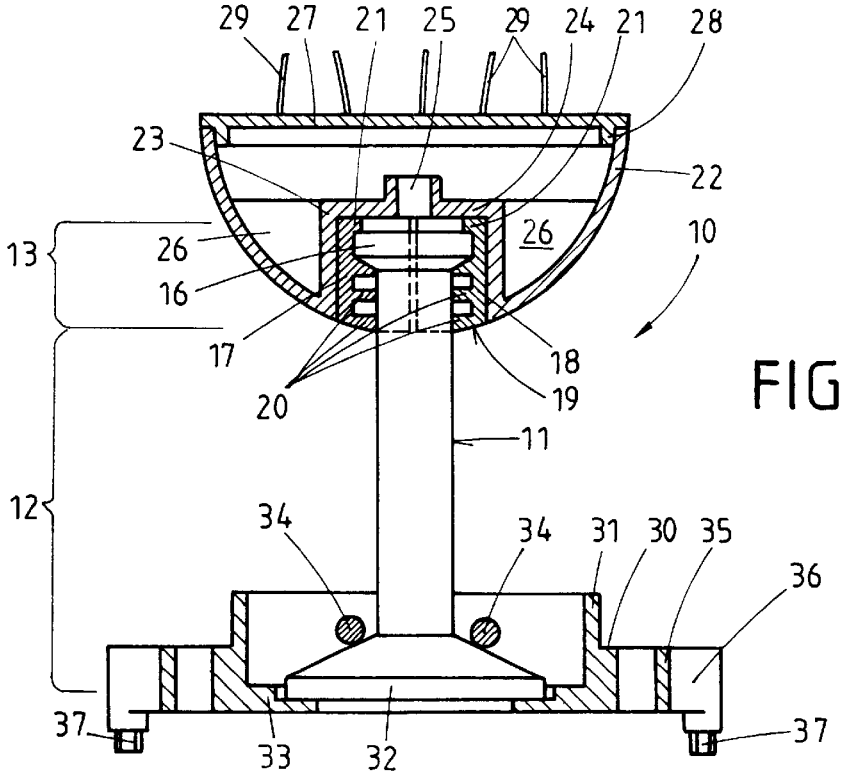
FIG.2

TRANSPORT ANCHOR FOR EMBEDDING IN PREFABRICATED REINFORCED CONCRETE PARTS

BACKGROUND OF THE INVENTION

1. Field of the Invention

The invention relates to a transport anchor to be embedded in prefabricated reinforced concrete parts such as slabs, supports, rings, boxes etc. The transport anchor comprises a shaft portion that can be anchored within the concrete and a shaft portion which projects from the concrete and has an engagement head which, during casting of the concrete, is surrounded by a removable recess member while the shaft portion that can be anchored within the concrete comprises a support having spacer projections maintaining a spacing to a formwork wall.

2. Description of the Related Art

It is known to use transport anchors of the aforementioned kind for lifting and transporting prefabricated reinforced concrete parts. These transport anchors are added to the reinforcement arrangement before casting the concrete and are anchored in the concrete after casting and curing of the concrete. In this respect it is known to use a recess member during casting of the concrete in order to prevent the shaft portion having the engagement head from projecting past the surface of the prefabricated concrete part. This recess member must be removed after casting and curing of the concrete in order to connect a lifting element to the now exposed engagement head of the shaft portion of the transport anchor. This lifting element, in turn, makes it possible to connect a crane hook etc. In this connection, the recess member is comprised of an elastic material such as, for example, rubber, and cannot be removed in a simple way from the cured concrete. Since the removal of the recess member from the concrete as well as the recess member itself incur costs, it is desirable to reuse the recess member several times. However, this is often not successful because the recess member is destroyed under deformation when removed from the concrete and pulled off the engagement head of the shaft portion.

SUMMARY OF THE INVENTION

It is an object of the present invention to improve a transport anchor of the aforementioned kind such that the recess member can be removed in a simple way from the transport anchor and is made of inexpensive material.

In accordance with the present invention, this is achieved in that the engagement head of the projecting shaft portion is surrounded by shell parts which complement one another to form a prism-shaped formed member onto which the recess member can be placed with its hub portion.

By employing two shell parts which complement one another to form a formed member, the recess member surrounding the shell parts can be easily pulled off in the upward direction because an interlocking engagement with the engagement head of the shaft portion of the transport anchor projecting from the concrete cannot occur, and, moreover, the shell parts can be taken off in a simple way in the radial direction once the recess member has been removed.

It is conceivable to design the shape of the engagement head of the shaft portion of the transport anchor to be embedded as well as the shape of the recess member in different ways. For example, the recess member can have the shape of a cube, a truncated cone etc., while the engagement head itself could be a rectangular or square plate or also in the form of an annular member. Preferably, the shaft and the engagement head, however, are cylindrical wherein the engagement head is a disc having a disc diameter which is greater than the diameter of the shaft. In this connection, the formed member surrounding the engagement head is advantageously comprised of two semi-circular ring-shaped shell parts which are surrounded by the hub portion of the recess member positive-lockingly and frictionally during the casting of the concrete.

According to a further feature of the invention, each semi-circular ring-shaped shell part has semi-annular support ribs projecting toward the shaft portion and contacting the shaft portion and also a semi-annular stop which engages the rim area of an end face of the shaft portion in order to prevent canting, i.e., to provide a stabilizing action for an axis-parallel position of the formed member on the engagement head of the transport anchor. In this connection, the recess member is advantageously formed as a semi-spherical open shell having an inner surface from which the cylindrical hub portion projects inwardly. The hub portion rests with its inner end face against the semi-annular stops of the shell parts.

In order to be able to employ the transport anchor not only on a horizontally extending formwork but also on a vertically extending formwork wall, the end face of the cylindrical hub portion of the recess member is provided with a preferably central bore by which the recess member can be fastened to a vertically extending wall by means of the screw. Subsequently, the engagement head of the transport anchor surrounded by the shell parts can be inserted into the hub portion of the recess member so that the transport anchor can project into the area where the concrete is to be cast. The hollow space which is formed by the recess member can be closed in that a lid is placed onto the side of the recess member opposite the hub portion. For the purpose of facilitating detection of the transport anchor in the cast concrete, this lid may comprise at least one, preferably however several, elastic indicator pins on the external side. These elastic indicator pins will stand up after smoothing a horizontal concrete surface so that it is easily recognized at which location a transport anchor is positioned within the concrete.

Especially for the purpose of placing the transport anchor onto a horizontally extending framework plate, the support of the transport anchor is advantageously formed of a receiving box with support fingers projecting away therefrom. A support disc which is connected to the shaft portion that can be embedded in the concrete is secured on the receiving box. In this connection, the support disc of the shaft portion to be embedded in the concrete is advantageously resting with its underside against the bottom of the receiving box, while the upper side of the support disc is spanned by securing bolts which are secured in the sidewalls of the receiving box and rest against the upper side. The support fingers of the receiving box which rest against a wall of the formwork are advantageously provided at their underside with at least one spacer projection which is configured to receive plug-in spacer members so that the position of the engagement head of the transport anchor can be adjusted to the respectively required thickness of the concrete elements.

BRIEF DESCRIPTION OF THE DRAWING

In the drawing:

FIG. 1 is a perspective view of the transport anchor according to the invention with support and attached recess member;

FIG. 2 is a longitudinal section in the section plane II—II of FIG. 1 of the transport anchor illustrated in FIG. 1;

DESCRIPTION OF THE PREFERRED EMBODIMENTS

Figure 4:
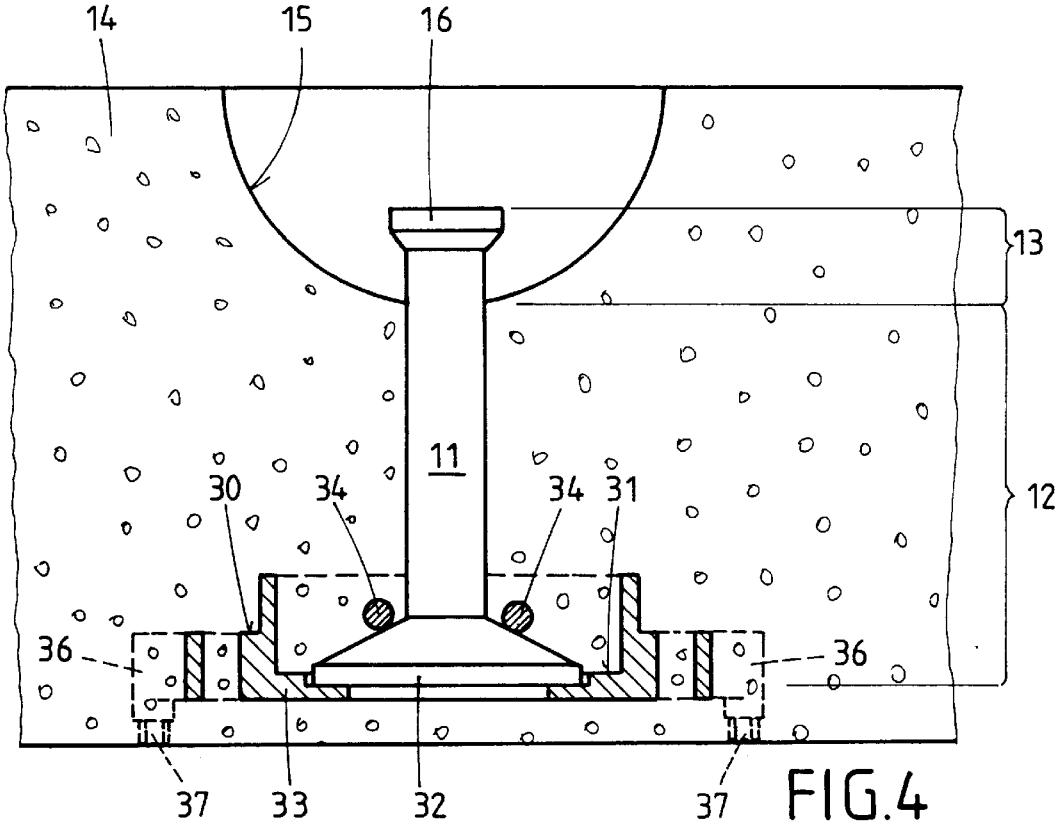
FIG. 4 is an illustration of the anchor positioned in the prefabricated reinforced concrete part with the shaft portion provided with the engagement head projecting into the recess of the prefabricated reinforced concrete part.

The transport anchor 10 illustrated in the drawings comprises an anchor shaft 11 whose shaft portion 12 can be embedded in the concrete and whose shaft portion 13 projects from the concrete into a recess 15 in the prefabricated reinforced concrete part 14 (FIG. 4). The projecting shaft portion 13 has an engagement head 16 at its free upper end which projects past the anchor shaft 11 in the radial direction. In the illustrated embodiment the anchor shaft 11 has a circular cross-section whose projecting shaft portion is a disc forming the engagement head 16. The disc has a disc diameter which is greater than the shaft diameter of the shaft portion 13. The underside of the disc has a transition, for example, of a truncated cone shape, into the shaft portion 13. The shaft portion 13 projecting from the concrete, together with its engagement head 16, is surrounded by semi-circular ring-shaped shell parts 17 and 18 which in the combined state complement one another to a prism-shaped formed member 19 which surrounds the shaft portion 13 when in the combined state. Each semi-circular ring-shaped shell part comprises below the engagement head 16 semi-circular ring-shaped support ribs 20 projecting toward and contacting the shaft portion 13 so that an axis-parallel contact of the shell parts 17 and 18 on the shaft portion 13 is ensured. Moreover, the upper end of the shell parts 17 and 18 is provided with a semi-annular stop 21, respectively, which engages a rim portion of the engagement head 16 of the projecting shaft portion 13. The hub portion 23 of the recess member 22 is positively as well as frictionally secured on the formed member 19 comprised of the shell parts 17 and 18. In the illustrated embodiment the recess member 22 is of a semi-spherical shape. Its hub portion 23 is cylindrical and projects radially inwardly. This hub portion 23 is open to the exterior and comprises an inner end face or end wall 24 which, in the position of use of the recess member 22, is supported on the semi-annular stops 21. The end face 24 of the hub portion 23 is provided with a bore 25 which is arranged advantageously in the central area of the end face 24 and is configured to receive a screw.

In this context, two different types of screws can be used. In particular, in a first scenario a screw for pushing away the recess member 22 from the prefabricated concrete part 14 is provided for which purpose a thread-cutting screw may be used and threaded into the bore 25 in the end face 24 of the hub portion 23. In this case, the recess member 22 can be moved out of the concrete part 14 by the end face of the screw contacting the engagement head 16. In the other scenario, a fastening screw is inserted from the interior through the bore 25 so that the screw head can rest at the end face 24 of the hub portion 23 in order to be able to secure the recess member 22 to a vertically extending formwork wall. The hub portion 23 is supported relative to the recess member 22 by several ribs 26 uniformly distributed about the circumference. The open side of the semi-spherical recess member 22 is closed off by a lid 27 during casting of the concrete, wherein the closing position is provided by positive-locking engagement of the annular projection 28 performed on the lid 27 which can be elastically clamped in the opening area of the recess member. The external side of the lid 27 has several elastic indicator pins 29 which during smoothing of the cast concrete will fold over and after smoothing will stand up again because of their own elasticity and thus indicate at which position a transport anchor is positioned in the concrete.

The shaft portion 12 of the anchor shaft 11 which can be embedded in the concrete comprises a support 30 which is formed of a receiving box 31 on which a support disc 32 is secured which is connected to the shaft portion 12 to be embedded in the concrete. While the anchor shaft 11 with its shaft parts 12, 13, the engagement head 16, and the support disc 32 can be formed as a monolithic part of a metallic material such as, for example, steel, the support 30 as well as the recess member 22, the shell parts 17 and 18, and also the lid 27 can be made of plastic. The support disc 32, which has, for example, a substantially greater diameter than the anchor shaft 11, rests with its underside against a recess of the bottom 33 of the receiving box 31, as illustrated in the drawings of the embodiment, while the upper side of the support disc 32 is spanned by securing bolts 34 which are secured in the sidewalls of the receiving box 31 and rest against the upper side of the support disc 32.

Figure 3:
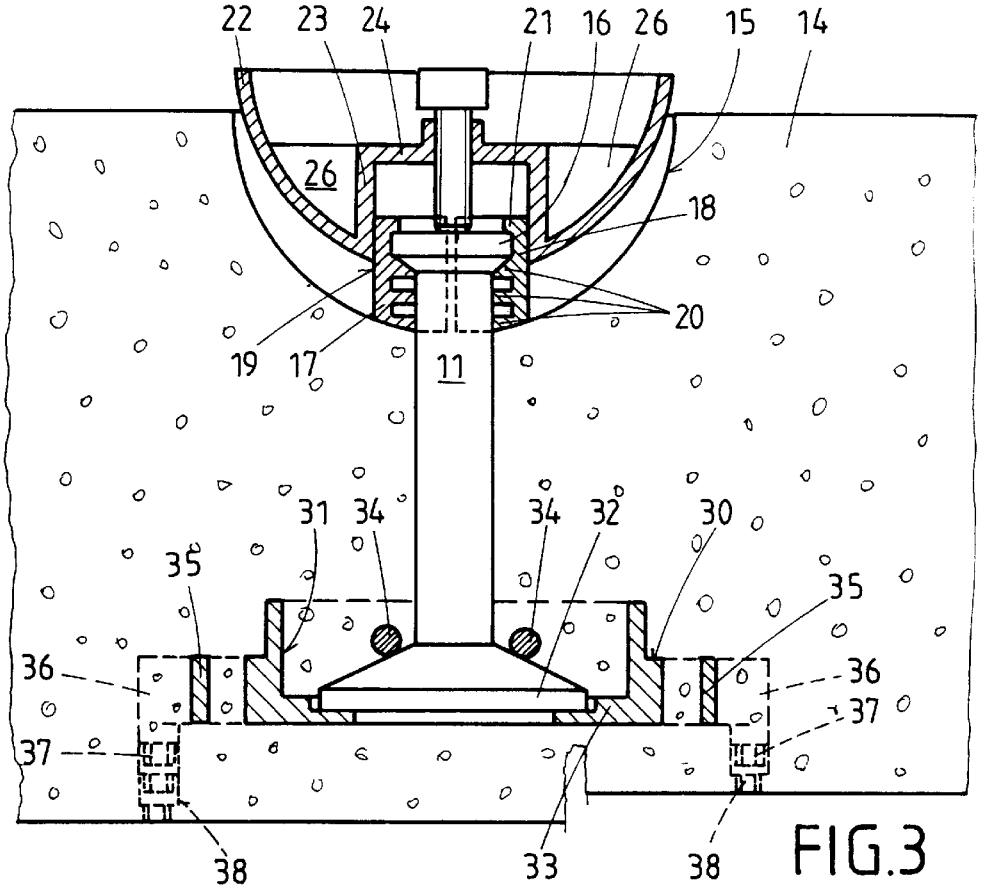
FIG. 3 is an illustration of the transport anchor embedded in the prefabricated reinforced concrete part with the lid being removed from the recess member and with the recess member itself being pushed out relative to the formed member secured on the engagement head of the shaft portion by means of a screw threaded into the recess member for the purpose of removal of the recess member.

In the illustrated embodiment the receiving box 31 has a square contour but it could also be of any other contour than the one illustrated, for example, it could be of a circular or polygonal shape. In the illustrated embodiment the lower area of the receiving box 31 having a square contour is surrounded with strip-shaped ribs 35, wherein support fingers 36 project from the respective corners of the ribs 35. Since the square basic contour of the receiving box 31 of the illustrated embodiment has, of course, four corners, there are therefore also four support fingers 36 projecting from its corners. For a shape which deviates from the illustrated square shape, it may be sufficient to have three support fingers uniformly distributed about the circumference. The support fingers 36 have at their underside spacer projections 37 which, as illustrated, for example, in FIG. 4, can rest directly on the formwork (not shown). However, in order to be able to adjust the transport anchor to the thickness of the prefabricated reinforced concrete part 14, it is possible to place spacer members 38 onto the spacer projections 37, which, as can be seen in FIG. 3, may have different heights. It is understood in this context that the spacer members 38 are designed such that they not only can be plugged or snapped onto the spacer members 37 but can also be plugged and connected to one another so that the transport anchors can be adjusted to any thickness of a prefabricated reinforced concrete part 14.

As has already been mentioned, the afore described and illustrated embodiment of the transport anchor according to the invention represents only one example of a realization of the invention, and the invention is not limited to this embodiment. Instead, further embodiments and variants of the subject matter of the invention are possible. Moreover, all of the features which are disclosed in the description and in the drawings are important with respect to the realization of the invention, even though they may not be expressly claimed in the claims.

While specific embodiments of the invention have been shown and described in detail to illustrate the inventive principles, it will be understood that the invention may be embodied otherwise without departing from such principles.

What is claimed is:

1. A transport anchor for embedding in prefabricated reinforced concrete parts, the transport anchor comprising:

an anchor shaft having a first shaft portion and a second shaft portion;

the first shaft portion configured to be anchored in the concrete and having a support with at least one spacer projection configured to maintain a spacing to a formwork wall;

the second shaft portion configured to project from the concrete and having an engagement head;

a prism-shaped formed member comprised of two shell parts and configured to surround the engagement head, wherein the prism-shaped formed member has a first end remote from the first shaft portion and a second end proximal to the first shaft portion;

a removable recess member having a hub portion configured to be placed axially onto the prism-shaped formed member from the first end in an axial direction of the anchor shaft and to thereby enclose the prism-shaped formed member and the engagement head during casting of the concrete without engaging the second end of the prism-shaped formed member and configured to be axially pulled off the prism-shaped formed member after casting of the concrete.

2. The transport anchor according to claim 1, wherein the anchor shaft and the engagement head are cylindrical and wherein the engagement head is a disc having a disc diameter that is greater than a shaft diameter of the anchor shaft.

3. The transport anchor according to claim 1, wherein the two shell parts of the formed member are semi-circular ring-shaped shell parts configured to be engaged positively and frictionally by the hub portion during the casting of the concrete.

4. The transport anchor according to claim 3, wherein each one of the semi-circular ring-shaped shell parts has inner semi-circular ring-shaped support ribs projecting radially inwardly to meet the second shaft portion and a semi-annular stop configured to engage a rim area on an end face of the second shaft portion.

5. The transport anchor according to claim 4, wherein the recess member comprises a semi-spherical shell and wherein the hub portion is cylindrical and projects radially inwardly from an inner surface of the semi-spherical shell, wherein the free end of the hub portion has an inner end face configured to rest against the semi-annular stops.

6. The transport anchor according to claim 5, wherein the inner end face of the hub portion has a bore configured to receive a screw.

7. The transport anchor according to claim 6, wherein the bore is a central bore.

8. The transport anchor according to claim 5, wherein the recess member further comprises a lid configured to close off an opening of the recess member opposite the hub portion.

9. The transport anchor according to claim 8, wherein the lid has at least one elastic indicator pin connected to a side of the lid facing away from the hub portion.

10. The transport anchor according to claim 1, wherein the support is comprised of a receiving box, having support fingers projecting away from the receiving box, wherein the first shaft portion has a support disc configured to be secured on the receiving box.

11. The transport anchor according to claim 10, wherein the support disc has an underside resting against a bottom of the receiving box and wherein the receiving box has securing bolts secured in a sidewall of the receiving box and configured to span and rest against an upper side of the support disc.

12. The transport anchor according to claim 10, wherein the support fingers have at least one of the spacer projections connected to an underside of the support fingers.

13. The transport anchor according to claim 12, wherein the spacer projections are configured to receive spacer members.

* * * * *